US009339912B2

(12) United States Patent
Chang et al.

(10) Patent No.: US 9,339,912 B2
(45) Date of Patent: May 17, 2016

(54) WAFER POLISHING TOOL USING ABRASIVE TAPE

(71) Applicant: Taiwan Semiconductor Manufacturing Company, Ltd., Hsin-Chu (TW)

(72) Inventors: Tang-Kuei Chang, Tainan (TW); Kuo-Hsiu Wei, Tainan (TW); Kei-Wei Chen, Tainan (TW); Wei-Jen Lo, Hsin-Chu (TW); Ying-Lang Wang, Tien-Chung Village (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 68 days.

(21) Appl. No.: 13/836,534

(22) Filed: Mar. 15, 2013

(65) Prior Publication Data

US 2014/0213153 A1 Jul. 31, 2014

Related U.S. Application Data

(60) Provisional application No. 61/759,076, filed on Jan. 31, 2013, provisional application No. 61/759,098, filed on Jan. 31, 2013.

(51) Int. Cl.

| | |
|---|---|
| ***B24B 21/04*** | (2006.01) |
| ***B24B 9/06*** | (2006.01) |
| ***B24B 21/00*** | (2006.01) |

(52) U.S. Cl.

CPC ..... *B24B 9/065* (2013.01); *B24B 21/004* (2013.01); *B24B 21/04* (2013.01)

(58) Field of Classification Search

CPC ..... B24B 9/065; B24B 21/04

USPC ..... 451/168, 173, 44, 63

See application file for complete search history.

(56) References Cited

U.S. PATENT DOCUMENTS

| | | | | |
|---|---|---|---|---|
| 5,209,027 | A * | 5/1993 | Ishida et al. | 451/41 |
| 5,643,044 | A * | 7/1997 | Lund | 451/5 |
| 5,938,504 | A * | 8/1999 | Talieh | 451/11 |
| 6,193,590 | B1 | 2/2001 | Weiss et al. | |
| 6,413,873 | B1 * | 7/2002 | Li et al. | 438/711 |
| 6,439,978 | B1 * | 8/2002 | Jones et al. | 451/168 |
| 7,367,873 | B2 | 5/2008 | Ishii et al. | |
| 7,621,799 | B2 | 11/2009 | Sakairi | |
| 7,976,361 | B2 | 7/2011 | Takahashi et al. | |
| 8,641,480 | B2 | 2/2014 | Nakanishi et al. | |
| 2001/0011002 | A1 | 8/2001 | Steere, III | |
| 2002/0016136 | A1 * | 2/2002 | Birang et al. | 451/41 |
| 2002/0098787 | A1 | 7/2002 | Kunisawa et al. | |
| 2002/0142707 | A1 | 10/2002 | Shimada et al. | |
| 2004/0072504 | A1 | 4/2004 | Tada | |
| 2006/0252355 | A1 | 11/2006 | Kumasaka | |
| 2007/0131654 | A1 | 6/2007 | Wasinger et al. | |
| 2008/0293335 | A1 | 11/2008 | Ettinger et al. | |
| 2009/0004952 | A1 | 1/2009 | Takahashi et al. | |
| 2009/0117828 | A1 | 5/2009 | Hongo et al. | |
| 2010/0112909 | A1 | 5/2010 | Yamaguchi et al. | |

* cited by examiner

*Primary Examiner* — Robert Rose

(74) *Attorney, Agent, or Firm* — Slater Matsil, LLP

(57) ABSTRACT

An embodiment wafer polishing tool includes an abrasive tape, a polish head holding the abrasive tape, and a rotation module. The rotation module is configured to rotate a wafer during a wafer polishing process, and the polish head is configured to apply pressure to the abrasive tape toward a first surface of the wafer during the wafer polishing process.

20 Claims, 5 Drawing Sheets

WAFER POLISHING TOOL USING ABRASIVE TAPE

This application claims the benefit of U.S. Provisional Application No. 61/759,076, filed on Jan. 31, 2013, entitled "Wafer Polishing Tool Using Abrasive Tape," and U.S. Provisional Application No. 61/759,098, filed on Jan. 31, 2013, entitled "Wafer Edge Trimming Tool Using Abrasive Tape," which application is hereby incorporated herein by reference.

This application relates to the following commonly assigned patent application filed on the same date as this application and entitled "Wafer Edge Trimming Tool Using Abrasive Tape", which application is included herein by reference.

TECHNICAL FIELD

The present disclosure relates generally to an integrated circuit and more particularly to a wafer polishing tool.

BACKGROUND

In some integrated circuit fabrication processes, wafer polishing processes (e.g., scrubber cleaning and/or backside/bevel cleaning processes) may use etching techniques or a combination of chemical and mechanical processes (e.g., CMP) to polish and clean surfaces of a wafer (e.g., the backside and bevel of the wafer). Generally, wafer polishing processes may be used to achieve an even, flat topography on surfaces of the wafer. A flat wafer surface is desirable for improving subsequent process steps, such as for improving photo overlay accuracy. However, conventional wafer polishing processes may be limited by the etching techniques in its ability to achieve a truly flat wafer surface. Furthermore, conventional wafer polishing processes may cause damage, such as cracks or peeling, to surfaces of the wafer.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

Figure 1A:
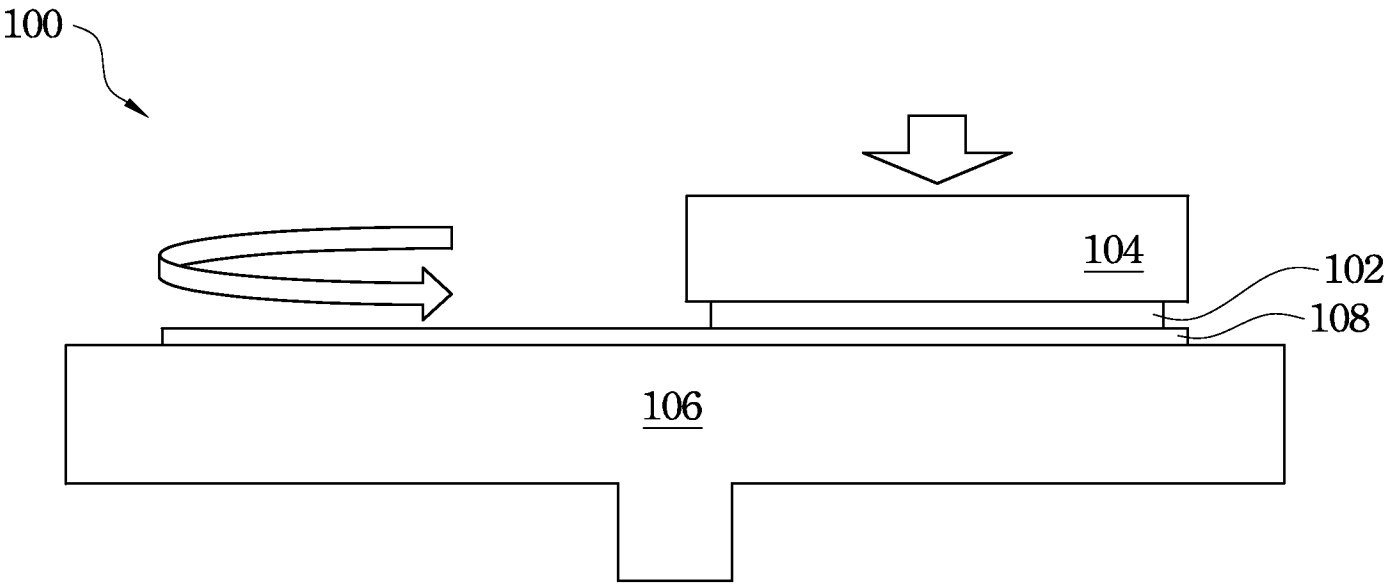
FIGS. 1A-1C are varying views of an exemplary wafer polishing tool according to various embodiments.

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

Various embodiments include using an abrasive tape to polish a surface of the wafer. The abrasive tape may polish a wafer without the use of a chemical slurry. The resulting wafer surface polished with abrasive tape may exhibit more even topography and less damage than wafer surfaces polished with conventional techniques (e.g., etching techniques).

FIG. 1A is a schematic diagram of an exemplary wafer polishing tool 100 according to various embodiments. Wafer polishing tool 100 includes an abrasive tape 102, a polishing head 104 holding abrasive tape 102, and a rotation module 106. A wafer 108 may be placed on rotation module 106 during the wafer polishing process. The surface of wafer 108 needing to be polished is placed facing upwards. Wafer 108 may be a semiconductor wafer comprising silicon, silicon dioxide, aluminum oxide, sapphire, germanium, gallium arsenide (GaAs), an alloy of silicon and germanium, indium phosphide (InP), and/or any other suitable material.

Rotation module 106 supports, holds, and rotates (as indicated by arrow 110) wafer 108 during the wafer polishing process. In various embodiments, rotation module 106 may be a mechanical chuck or a vacuum chuck. In FIG. 1A, rotation module 106 is illustrated as a vacuum chuck. Although FIG. 1A illustrates rotation module 106 as rotating in the counter-clockwise direction indicated by arrow 110, rotation module 106 may also be rotated in the opposite, clockwise direction. Polishing head 104 applies downward pressure (indicated by arrow 112) on abrasive tape 102 so that abrasive tape 102 contacts the surface wafer 108 needing to be polished (i.e., the upward facing surface of wafer 108) during the wafer polishing process. Polishing head 104 may or may not be rotated as well. As wafer 108 is rotated against abrasive tape 102, the surface in contact with and against abrasive tape 102 may be polished through a mechanical grinding force. Notably, unlike some conventional wafer polishing processes, wafer polishing tool 100 does not require a chemical slurry be dispensed over the wafer during the wafer polishing process.

In various embodiments, abrasive tape 102 may be an abrasive material bonded to a base film (sometimes referred to as a base tape). The abrasive material is oriented facing towards the wafer during wafer polishing. For example, in FIGS. 1A-1D, the abrasive material of abrasive tape 102 would be oriented facing downward (contacting wafer 108) while the base film of abrasive tape 102 would be oriented facing upward. The abrasive material may be diamond, diamond powder, silica dioxide, cerium oxide, silicon carbide, aluminum oxide, combinations thereof, and the like. The base film may be formed of polyethylene terephthalate (PET), polyester, or the like. Furthermore, abrasive tape 102 may have, for example, a width between 2 mm to 30 mm and a length of 20 m or more.

For example, abrasive tape 102 may include diamond powder having a grain size between 0.5 μm to 30 μm that is bonded to a polyester base film with a thickness between 20 μm to 150 μm. In another example, abrasive tape 102 may include a layer of diamond powder having a 9 μm grain size bonded to a PET base film having a width of about 25 mm, a thickness of 50 μm, and a length of 20 m. Because of the abrasive tape 102 may include diamonds or diamond powder, abrasive tape 102 may alternatively be referred to as diamond tape 102.

In various embodiments, abrasive tape 102 may be configured in a long, rectangular shape that is stored in a roll and dispensed from rollers in a polishing head. As portions of abrasive tape 102 come in contact with wafer 108, these portions may become worn and require periodic replacement. By storing abrasive tape 102 in a roll on a roller, fresh (i.e., unworn) portions of abrasive tape 102 may be dispensed (i.e., rolled out) as used portions of abrasive tape 102 become worn. The wafer polishing process may proceed with minimum interruptions using a fresh portion of abrasive tape 102. That is, the wafer polishing process need not be interrupted frequently to replace worn portions of abrasive tape 102 because fresh portions are rolled out automatically.

For example, in various embodiments, polishing head 104 houses rollers (not shown) holding abrasive tape 102, which may be configured as a long rectangle, in position during the wafer polishing process. The rollers in polishing head 104 roll out fresh portions of abrasive tape 102 as used portions become worn. Alternatively, abrasive tape 102 may be held in place by polishing head 104 using another method, and abrasive tape 102 may be configured in an alternative shape (e.g., a circular shape). Worn portions of abrasive tape 102 may be replaced manually as needed.

In various embodiments, Polishing head 104 may be formed of polyphenylene sulfide (PPS), polyvinyl chloride (PVC), polyether ether ketone (PEEK), rubber, combinations thereof, or any other suitable material. Polishing head 104 may be disposed in any relative position over wafer 108. For example polishing head 104 may be disposed in any of the relative positions illustrated in FIGS. 1B and 1C.

Figure 1C:
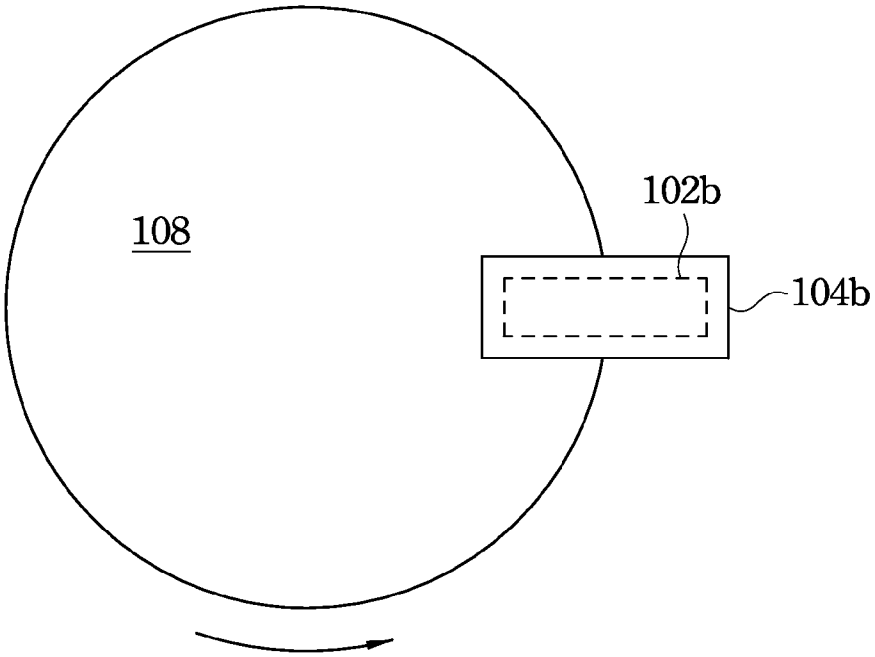
Figure 1B:
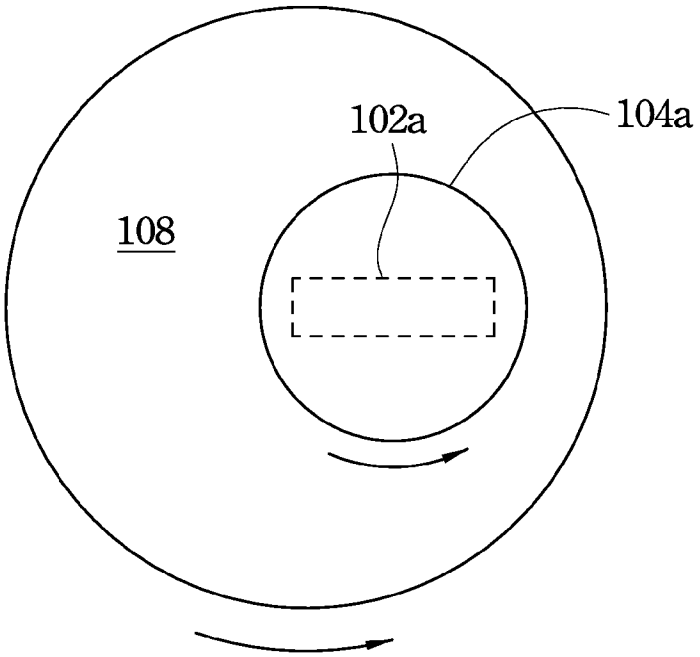

FIGS. 1B and 1C are top-down views of a wafer polishing tool such as wafer polishing tool 100 in FIG. 1A according to varying embodiments. FIG. 1B is a top-down view of an exemplary wafer center polishing tool, referred to as such because polishing head 104*a* is disposed over a center region of wafer 108. Polishing head 104*a* has a circular shape and may rotate during the wafer polishing process. Polishing head 104*a* may, for example, have a diameter of about 180 mm, holding an abrasive tape 102*a* having, for example, a width of about 25 mm width and a thickness of about 50 μm.

For example, wafer 108 may be rotated at 1500 rpm and polish head 104*a* may be rotated at 500 rpm. Furthermore, polishing head 104*a* may apply a downward force, ranging from about 10 N to 50 N, pressing abrasive tape 102*a* against wafer 108.

FIG. 1C is a top-down view of an exemplary wafer edge polishing tool, referred to as such because polishing head 104*b* is disposed over an edge region of wafer 108. Polishing head 104*b* has a rectangular shape and may not rotate. In various embodiments, polishing head 104*b* has a size of, for example, about 1100 $mm^2$-1350 $mm^2$. For example, wafer 108 may be rotated at about 1000 rpm, and polishing head 104*b* may apply a downward force ranging between about 10 N to 50 N. Polishing head 104*b* holds the abrasive tape 102*b*, which may have a width ranging from about 25 mm to 40 mm and a thickness of about 50 μm.

In alternative embodiments, polishing heads 104*a*/104*b* and abrasive tape 102*a*/102*b* may be configured in different shapes than those illustrated in FIGS. 1B and 1C.

In various embodiments, separate portions wafer 108 may be polished in separate process steps. For example, center regions of wafer 108 may first be polished using a wafer center polishing tool (e.g., as illustrated by FIG. 1B). Edge portions of wafer 108 may subsequently be polished using a wafer edge polishing tool (e.g., as illustrated by FIG. 1C).

Figure 1D:
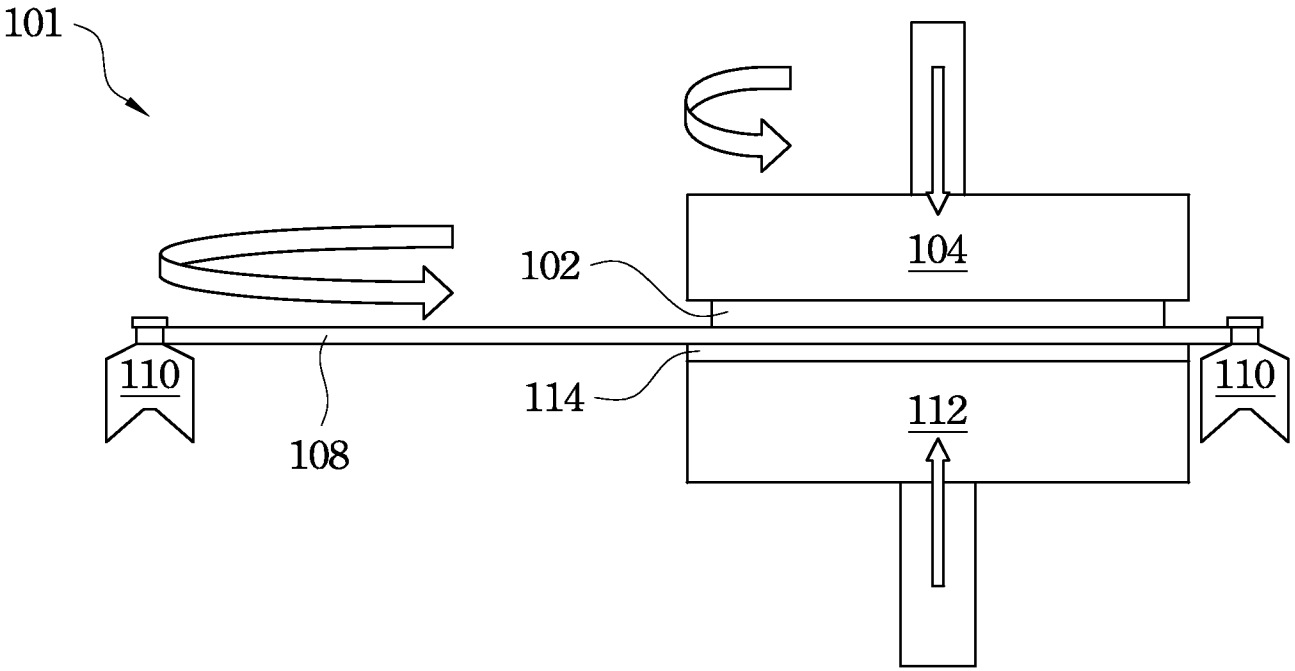
FIG. 1D is a schematic diagram of an exemplary wafer polishing tool according to alternative embodiments.

FIG. 1D is a schematic diagram of an exemplary wafer polishing tool 101 according to alternative embodiments. Wafer polishing tool 101 may be an alternative embodiment of a wafer center polishing tool illustrated in FIG. 1B. Polishing head 104 has a circular shape and may have a diameter, for example, of about 180 mm. Polishing head 104 may be rotated during the wafer polishing process.

Wafer polishing tool 101 includes a rotation module implemented a mechanical chuck 114 (illustrated as fixing points). Mechanical chuck 114 may have a varying number of fixing points. For example, in various alternative embodiments, mechanical chuck 114 may have between three and eight fixing points. Mechanical chuck 114 attaches to edge portions of wafer 108 and holds wafer 108 in place during the wafer polishing process.

Wafer polishing tool 101 also includes a bottom plate 116 that provides support for wafer 108 during the wafer polishing process. Bottom plate 116 also balances the pressure applied to wafer 108 from the polish head 104. Bottom plate 116 may comprise polyphenylene sulfide (PPS), polyvinyl chloride (PVC), polyether ether ketone (PEEK), rubber, combinations thereof, or any other suitable material.

In various embodiments illustrated by FIG. 1D, bottom plate 116 applies a fluid to a surface of wafer 108 opposite the surface to be polished (e.g. the bottom facing surface of wafer 108) for lubrication, cleaning, and support during the wafer polishing process. For example, deionized water (DIW) may be applied to the bottom facing surface of wafer 108 at a rate ranging from about 0.6 L/min to 1.0 L/min.

Figure 2:
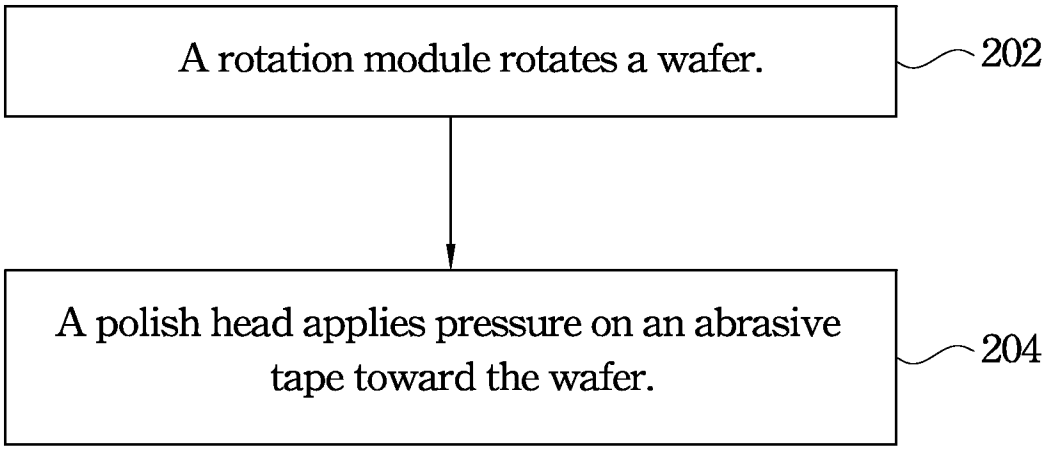
FIG. 2 is a flowchart of an exemplary method of wafer polishing using a wafer polishing tool illustrated in FIGS. 1A-1D according to various embodiments.

FIG. 2 is a flow chart of an exemplary wafer polishing method using the wafer polishing tool illustrated in FIGS. 1A-1D (e.g., wafer polishing tools 100 or 101) according to various embodiments. In step 202, a wafer (e.g., wafer 108) is placed on a rotation module (e.g., rotation module 106). The surface of the wafer to be polished is placed facing upwards. Rotation module 106 may be a vacuum chuck or it may be mechanical chuck having fixing points holding edge portions of a wafer and a bottom plate to support the wafer. In embodiments, wherein the rotation module includes a bottom plate, DIW may be dispensed over surfaces of the wafer opposite the surface to undergoing the polishing process. The dispensing of DIW cleans and lubricates the wafer during the polishing process. The rotation module rotates the wafer during the wafer polishing process.

In step 204, a polishing head (e.g., polishing head 104) applies downward pressure on an abrasive tape (e.g., abrasive tape 102) towards the wafer. The polishing head may or may not rotate. The abrasive tape contacts the wafer during the wafer polishing process, and the wafer is thus polished via mechanical grinding. The abrasive tape may be stored on rollers in the polishing head. As portions of the abrasive tape become worn, fresh portions are rolled out. Furthermore, the polishing head may be positioned in any relative position over the wafer. For example, the polishing head may be positioned over a center region or an edge region of the wafer. The surface of the wafer may be polished in separate process steps.

In some embodiments, the abrasive tape comprises a base film and an abrasive material layer bonded to the base tape. The abrasive material layer comprises diamond, diamond powder, silica dioxide, cerium oxide, silicon carbide, aluminum oxide, any combination thereof, or any other suitable material. The base film comprises polyethylene terephthalate (PET) or polyester. In some embodiments, the abrasive material layer comprises diamond powder with a grain size ranging from 0.5 μm to 30 μm bonded to a PET or polyester base film.

Figure 3:
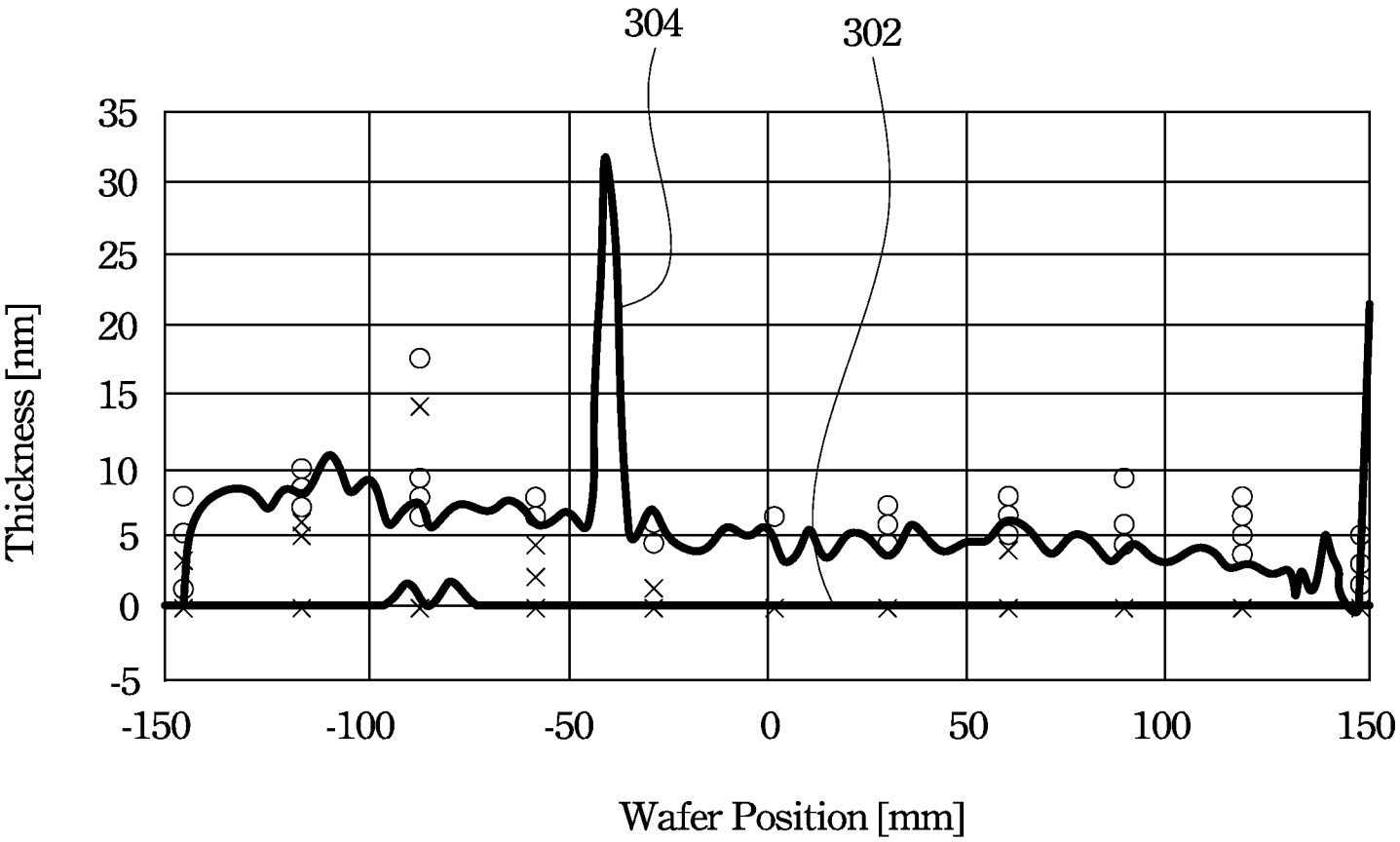
FIG. 3 is a plot showing the wafer thickness variation after being polished using the wafer polishing tool in FIGS. 1A-1D compared to a conventional wafer polishing tool.

It has also been observed that a wafer polished using abrasive tape is less susceptible to damage and irregularities than a wafer polished using conventional methods. For example, FIG. 3 is a graph comparing the topography (wafer thickness) of a wafer polished using wafer polishing tool using abrasive tape (e.g., polishing tool 100 or 101) compared to the topography of a wafer polished using conventional methods (e.g., involving an etching technique). Line 302 illustrates the topography of a wafer polished using wafer polishing tool using abrasive tape, while line 304 illustrates the topography of a wafer polished using conventional methods. As illustrated by FIG. 3, the wafer represented by line 302 exhibits improved, more even topography than the wafer represented by line 304. This more even topography advantageously improves the accuracy of subsequent process steps, e.g., it improves photo overlay accuracy.

In accordance with an embodiment, a wafer polishing tool includes an abrasive tape, a polish head holding the abrasive tape, and a rotation module. The rotation module is configured to rotate a wafer during a wafer polishing process, and the polish head is configured to apply pressure to the abrasive tape toward a first surface of the wafer during the wafer polishing process.

In accordance with another embodiment, a method for wafer polishing includes placing a wafer on a rotation module, rotating the wafer with the rotation module, and polishing a first surface by a wafer by applying an abrasive tape against the first surface of the wafer with a polishing head.

In accordance with yet another embodiment, a wafer polishing tool includes a diamond tape comprising diamond powder bonded to a base tape, a polishing head holding the diamond tape, and a rotation module. The rotation module is configured to rotate a wafer during a wafer polishing process, and the polishing head is configured to apply pressure on the diamond tape to position the abrasive tape against the wafer during the wafer polishing process.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A wafer polishing tool, comprising:

a polishing head configured to hold an abrasive tape;

a rotation module configured to rotate a wafer during a wafer polishing process, wherein the polishing head is configured to rotate the abrasive tape around an axis and press the abrasive tape on a first region of a first surface of the wafer during the wafer polishing process, wherein the first region is smaller than the first surface, wherein the axis intersects the abrasive tape, and wherein the polishing head is configured to rotate the abrasive tape in a plane parallel to the first surface of the wafer during the wafer polishing process; and a bottom plate configured to provide support on a second region of a second surface of the wafer opposite the first surface during the wafer polishing process, wherein the first region of the first surface is directly opposite the second region of the second surface, wherein the bottom plate has a width smaller than a diameter of the wafer.

2. The wafer polishing tool of claim 1, wherein the bottom plate is configured to apply a fluid on the second surface of the wafer during the wafer polishing process.

3. The wafer polishing tool of claim 2, wherein the fluid is deionized water (DIW).

4. The wafer polishing tool of claim 1, wherein the abrasive tape comprises an abrasive material layer bonded to a base film.

5. The wafer polishing tool of claim 4, wherein the abrasive material layer comprises diamond, silica dioxide, cerium oxide, silicon carbide, aluminum oxide, or any combination thereof.

6. The wafer polishing tool of claim 4, wherein the abrasive material layer comprises diamond powder with a grain size ranging from 0.5 μm to 30 μm.

7. The wafer polishing tool of claim 4, wherein the base film comprises polyethylene terephthalate (PET) or polyester.

8. The wafer polishing tool of claim 1, wherein the polishing head comprises polyphenylene sulfide (PPS), polyvinyl chloride (PVC), polyether ether ketone (PEEK), rubber, or any combination thereof.

9. The wafer polishing tool of claim 1, wherein the rotation module is a mechanical chuck configured to hold the wafer at a number of predetermined discrete locations along the edge of the wafer.

10. The wafer polishing tool of claim 9, wherein the rotation module is a mechanical chuck having between three to eight fixing points for holding the wafer.

11. A method for wafer polishing, comprising:

placing a wafer on a rotation module;

rotating the wafer with the rotation module; and polishing a first surface of the wafer by applying an abrasive tape against the first surface of the wafer with a polishing head, the abrasive tape rotating around an axis, the axis intersecting the abrasive tape, the abrasive tape rotating in a plane parallel to the first surface of the wafer, and a center region and an edge region of the first surface of the wafer being polished in separate process steps.

12. The method of claim 11, further comprising rotating the polishing head.

13. The method of claim 11, further comprising providing support on a second surface of the wafer using a bottom plate, wherein the second surface is opposite the first surface of the wafer.

14. The method of claim 13, further comprising applying a fluid on the second surface of the wafer using the bottom plate.

15. The method of claim 11, wherein polishing the first surface of the wafer further comprises disposing the polishing head over an edge region of the wafer.

16. The method of claim 11, wherein polishing the first surface of the wafer further comprises disposing the polishing head over a center region of the wafer.

17. The method of claim 11, further comprising:

storing the abrasive tape in the polishing head on a roll; and rolling out a fresh portion of the abrasive tape when a used portion of the abrasive tape becomes worn.

18. A wafer polishing tool, comprising:

a polishing head configured to hold a diamond tape comprising diamond powder bonded to a base tape, wherein the polishing head is configured to rotate the diamond tape around an axis during a wafer polishing process, and wherein the axis intersects the diamond tape; and a rotation module, wherein the rotation module is configured to rotate a wafer during the wafer polishing process, wherein a size of the diamond tape is smaller than a size of the wafer, wherein the polishing head is configured to apply pressure on the diamond tape to position the diamond tape against a first surface of the wafer during the wafer polishing process, and wherein the polishing head is configured to rotate the diamond tape in a plane parallel to the first surface of the wafer during the wafer polishing process.

19. The wafer polishing tool of claim 1, wherein the wafer polishing tool is configured to polish a center region of the wafer and an edge region of the wafer in separate process steps.

20. The wafer polishing tool of claim 1, wherein the abrasive tape has a thickness of about 50 μm.

* * * * *